US010906787B2

(12) United States Patent
Grayson

(10) Patent No.: US 10,906,787 B2
(45) Date of Patent: Feb. 2, 2021

(54) SELECTIVELY POSITIONABLE WINCH ASSEMBLIES WITH RELEASABLE CLAMPS

(71) Applicant: Glenn Grayson, Liberty Township, OH (US)

(72) Inventor: Glenn Grayson, Liberty Township, OH (US)

( * ) Notice: Subject to any disclaimer, the term of this patent is extended or adjusted under 35 U.S.C. 154(b) by 0 days.

(21) Appl. No.: 16/682,058

(22) Filed: Nov. 13, 2019

(65) Prior Publication Data

US 2020/0148514 A1 May 14, 2020

Related U.S. Application Data

(60) Provisional application No. 62/760,438, filed on Nov. 13, 2018.

(51) Int. Cl.
*B66D 1/28* (2006.01)
*B66D 1/46* (2006.01)

(52) U.S. Cl.
CPC ..... *B66D 1/28* (2013.01); *B66D 1/46* (2013.01); *B66D 2700/0141* (2013.01); *B66D 2700/0183* (2013.01)

(58) Field of Classification Search
CPC ... B66D 1/12; B66D 1/18; B66D 1/28; B66D 1/39; B66D 1/66; B66D 3/20; B66D 3/26; B66D 2700/0183
IPC ..... B66D 1/12,1/18, 1/28, 1/39, 1/66, B66D 3/20, 3/26, 2700/0183
See application file for complete search history.

(56) References Cited

U.S. PATENT DOCUMENTS 3,810,383 A * 5/1974 Matherne ..... E21B 47/1025 73/40.5 R
4,239,443 A * 12/1980 Rysewyk ..... B66F 9/06 414/618
4,635,875 A * 1/1987 Apple ..... B66D 1/36 242/155 BW
4,650,163 A * 3/1987 Peterson ..... B66D 1/00 254/327
6,152,425 A * 11/2000 Boyer ..... B66D 1/60 254/323
6,386,514 B1 * 5/2002 Ray ..... B66D 1/12 254/323
6,494,437 B1 * 12/2002 Boyer ..... B66D 5/08 254/323
6,966,544 B2 * 11/2005 McCormick ..... B66B 1/32 254/342
7,344,120 B2 * 3/2008 McFarland ..... B66D 1/00 224/511

(Continued)

*Primary Examiner* — Emmanuel M Marcelo
(74) *Attorney, Agent, or Firm* — Dinsmore & Shohl LLP

(57) ABSTRACT

A winch assembly including a winch housing body, an attachment structure, and one or more releasable clamps. The winch housing body may comprise a front wall, a rear wall, and at least one connecting wall that extends between the front wall and the rear wall. The front wall, rear wall, and connecting wall define a winch-receiving volume sized to house a winch device therein. The winch device may include a motor, a drum that is operatively connected to the motor, and a cable that is operatively connected to the drum. The attachment structure may be attached to the distal end of the cable. The one or more releasable clamps may be mounted to the rear wall. The one or more releasable clamps may be configured to clamp onto support rails of differing widths.

20 Claims, 7 Drawing Sheets

(56) References Cited

U.S. PATENT DOCUMENTS

| | | | | |
|---|---|---|---|---|
| 7,913,978 | B1 * | 3/2011 | Trihey | B66D 3/006 254/323 |
| 10,431,965 | B2 * | 10/2019 | Palmer | H02G 1/081 |
| 2003/0230744 | A1 * | 12/2003 | Rawlinson | A01B 59/066 254/323 |
| 2006/0201980 | A1 * | 9/2006 | Koons | B60D 1/07 224/511 |
| 2007/0163982 | A1 * | 7/2007 | Lichinchi | B60P 1/5471 212/175 |
| 2008/0048162 | A1 * | 2/2008 | Grapes | B66D 1/04 254/323 |
| 2009/0127526 | A1 * | 5/2009 | Zaruba | B65H 51/10 254/332 |
| 2011/0248228 | A1 * | 10/2011 | Gause | B66D 3/006 254/323 |
| 2012/0145980 | A1 * | 6/2012 | Harrison | B60D 1/02 254/323 |
| 2015/0329335 | A1 * | 11/2015 | Azzarelli | B66D 1/12 254/323 |
| 2018/0117718 | A1 * | 5/2018 | Rajagopalan | B23K 37/0531 |
| 2018/0161833 | A1 * | 6/2018 | Zink | B65H 51/10 |

* cited by examiner

SELECTIVELY POSITIONABLE WINCH ASSEMBLIES WITH RELEASABLE CLAMPS

CROSS-REFERENCE TO RELATED APPLICATIONS

This application claims the benefit of U.S. Provisional Application No. 62/760,438 filed Nov. 13, 2018, the entirety of which is incorporated by reference herein.

BACKGROUND

Field

The present specification generally relates to winch assemblies and methods, and more specifically, to winch assemblies that may be selectively positioned on objects of interest with releasable clamps.

Technical Background

Winch assemblies can be used to move or reorient objects of interest. Many winch assemblies are heavy assemblies and are bolted or otherwise fixed to an object of interest. Removing standard winch assemblies from a first object of interest and attaching them to a second object of interest may prove difficult and time-consuming for users.

Accordingly, a need exists for alternative winch assemblies which can be selectively positioned on various objects of interest with relative ease using releasable clamps.

SUMMARY

According to a first aspect, a winch assembly comprising a winch housing body, an attachment structure, and one or more releasable clamps. The winch housing body may comprise a front wall, a rear wall, and at least one connecting wall that extends between the front wall and the rear wall. The front wall, rear wall, and connecting wall define a winch-receiving volume sized to house a winch device therein. The winch device may include a motor, a drum that is operatively connected to the motor, and a cable that is operatively connected to the drum. The attachment structure may be attached to the distal end of the cable. The one or more releasable clamps may be mounted to the rear wall. The one or more releasable clamps may be configured to clamp onto support rails of differing widths.

Another aspect includes a winch assembly according to any of the previous aspects, where the front wall includes a cable receiving aperture through which the cable extends during a winching operation.

Another aspect includes a winch assembly according to any of the previous aspects, where the front wall has a shorter length than the rear wall, providing an open area wherein the motor of the winch device is housed.

Another aspect includes a winch assembly according to any of the previous aspects, where the winch assembly includes an electrical cover that is attached to the at least one connecting wall.

Another aspect includes a winch assembly according to any of the previous aspects, where the at least one connecting wall is one of a top wall and a bottom wall.

Another aspect includes a winch assembly according to any of the previous aspects, where a bottom wall has the same length as a front wall.

Another aspect includes a winch assembly according to any of the previous aspects, where an electrical cover is attached to a top wall within the open area.

Another aspect includes a winch assembly according to any of the previous aspects, where the at least one connecting wall includes an aperture that is configured to allow a user access to the winch device.

Another aspect includes a winch assembly according to any of the previous aspects, where the aperture in the at least one connecting wall has a larger area than the cable-receiving aperture in the front wall.

Another aspect includes a winch assembly according to any of the previous aspects, where both a top and bottom wall include an aperture configured to allow a user access to the winch device.

Another aspect includes a winch assembly according to any of the previous aspects, where the aperture in the top wall is positioned over the aperture in the bottom wall.

Another aspect includes a winch assembly according to any of the previous aspects, where the drum is positioned between the aperture in the top wall and the aperture in the bottom wall, providing users with access to the drum and the cable operatively connected to the drum.

Another aspect includes a winch assembly according to any of the previous aspects, where the one or more releasable clamps include a first portion and a second portion rotatively coupled to the first portion.

Another aspect includes a winch assembly according to any of the previous aspects, where the second portion of the one or more releasable clamps is selectively coupled to the first portion of the one or more releasable clamps with a threaded fastener.

According to a second aspect, a method of moving an object with a winch assembly is provided. The method includes detaching a winch assembly from a first position, attaching the winch assembly to a second position using one or more releasable clamps, and activating the winch assembly. The winch assembly may comprise a winch housing body, an attachment structure, and one or more releasable clamps. The winch housing body may comprise a front wall, a rear wall, and at least one connecting wall that extends between the front wall and the rear wall. The front wall, rear wall, and connecting wall define a winch-receiving volume sized to house a winch device therein. The winch device may include a motor, a drum that is operatively connected to the motor, and a cable that is operatively connected to the drum. The attachment structure may be attached to the distal end of the cable. The one or more releasable clamps may be mounted to the rear wall. The one or more releasable clamps may be configured to clamp onto support rails of differing widths.

Another aspect includes a method according to any of the previous aspects, where the first position and the second position are different positions on the same object.

Another aspect includes a method according to any of the previous aspects, where the winch assembly, when attached to the first position and activated, moves the object in a first direction, and where the winch assembly, when attached to the second position and activated, moves the object in a second direction.

Another aspect includes a method according to any of the previous aspects, where the first position and the second position are on different objects.

Another aspect includes a method according to any of the previous aspects, where the winch assembly is detached from the first position by loosening the one or more releasable clamps and the winch assembly is attached to the second position by tightening the one more releasable clamps.

Another aspect includes a method according to any of the previous aspects, where the winch assembly is activated by an electric remote controller.

Additional features and advantages of the embodiments described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1A:
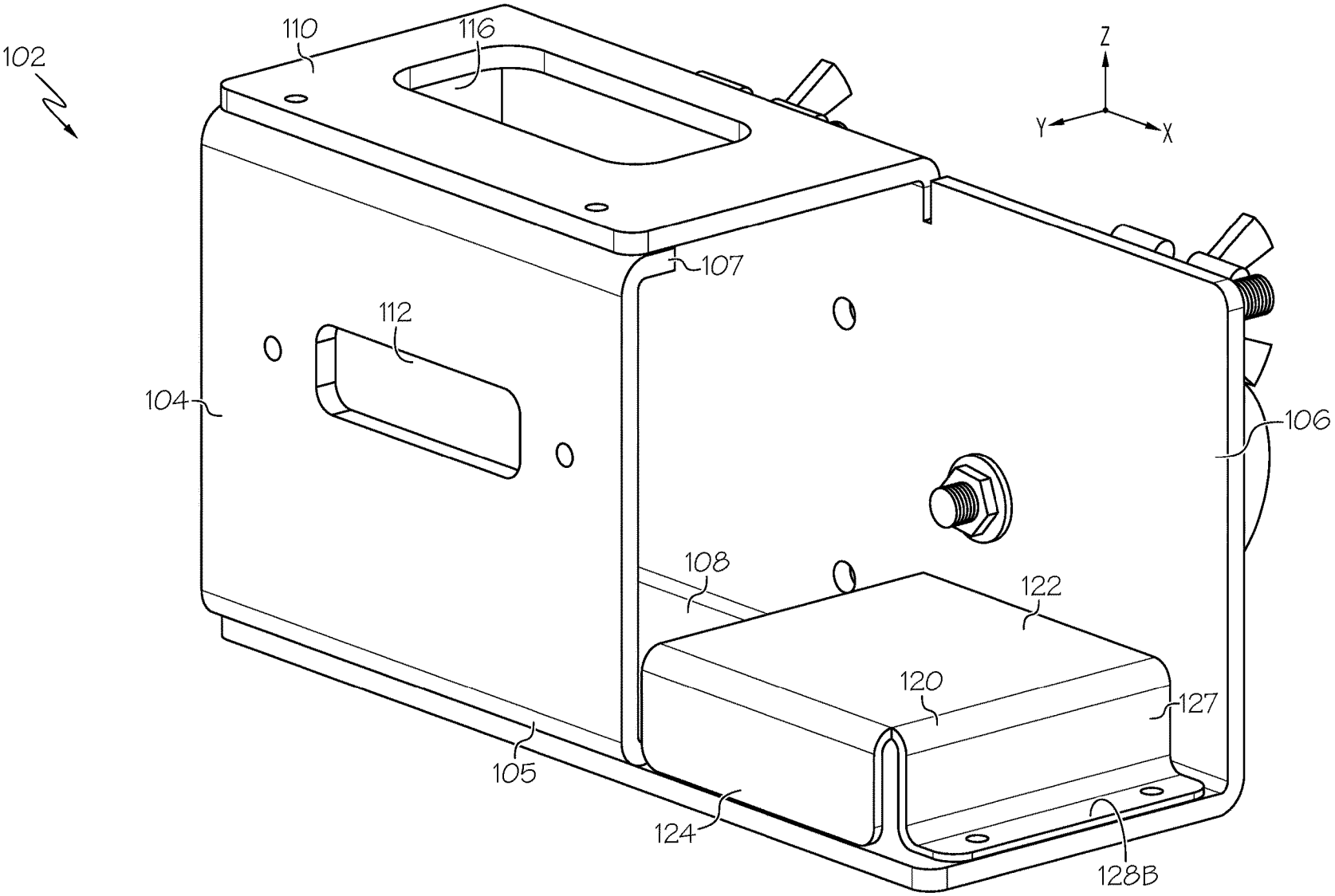
FIG. 1A is a front perspective view of a winch housing body, according to one or more embodiment shown or described herein.

Reference will now be made in detail to embodiments of winch assemblies and methods of using the same, examples of which are illustrated in the accompanying drawings. Whenever possible, the same reference numerals will be used throughout the drawings to refer to the same or like parts.

Embodiments described herein are generally directed to a winch assembly and methods of using the same. The winch assembly may include a winch housing body, an attachment structure, and one or more releasable clamps. The winch housing body may comprise a front wall, a rear wall, and at least one connecting wall that extends between the front wall and the rear wall. The front wall, rear wall, and connecting wall define a winch-receiving volume sized to house a winch device therein. The winch device may include a motor, a drum that is operatively connected to the motor, and a cable that is operatively connected to the drum. The attachment structure may be attached to the distal end of the cable. The one or more releasable clamps may be mounted to the rear wall. The one or more releasable clamps may be configured to clamp onto support rails of differing widths.

Figure 1B:
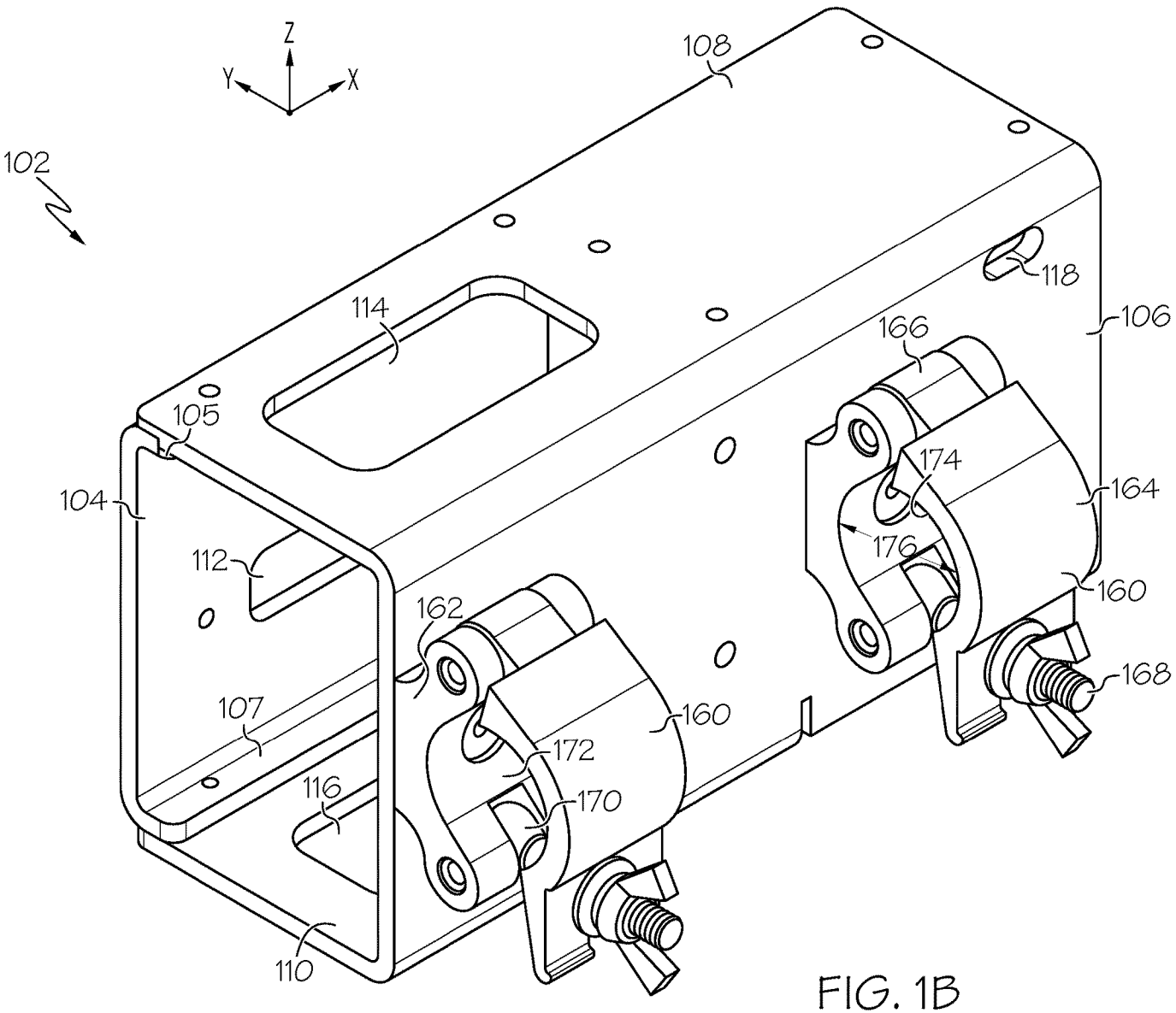
FIG. 1B is a rear perspective view of the winch housing body of FIG. 1A, according to one or more embodiments shown or described herein.

Referring first to FIGS. 1A and 1B, a winch housing body 102 of a winch assembly 100 is depicted. Winch housing body 102 is generally comprised of four walls, a front wall 104, a rear wall 106, a top wall 108, and a bottom wall 110. As used herein, the terms "top," "bottom," "front," "rear," "superior," "inferior," and the like are merely for description as to the components of the winch assemblies as illustrated and are not meant to denote absolute orientation. For example, the top wall 108 and the bottom wall 110 may be referred to as connecting walls. Additionally, the winch assembly 100 may be fully operational in any orientation, regardless of the positioning of the walls 104, 106, 108, and 110 in relation to each other. With reference to FIG. 1B specifically, front wall 104 may include top lip 105 and bottom lip 107. Top lip 105 may include through bores that are located to mate with through bores through the top wall 108. Bottom lip 107 may include through bores that are located to mate with through bores through the bottom wall 110. When front wall 104 is attached to winch housing body 102, top lip 105 may sit just beneath top wall 108, and bottom lip 107 may rest on bottom wall 110. Through bores in top wall 108 may overlap with through bores in top lip 105. Through bores in bottom wall 110 may overlap with through bores in bottom lip 107. Bolts or other fasteners may be inserted through the aligned top and bottom through bores, securing front wall 104 to winch housing body 102, including rear wall 106, top wall 108, and bottom wall 110.

Reference will now be made to the relative dimensions of walls 104, 106, 108, and 110. Height is measured along the z axis of the global coordinate system provided in FIGS. 1A and 1B, length is measured along the x axis of the global coordinate system provided in FIGS. 1A and 1B, and width is measured along the y axis of the global coordinate system provided in FIGS. 1A and 1B. In some embodiments, a height of front wall 104 is substantially equal to a height of rear wall 106. In some embodiments, the width of top wall 108 is substantially equal to the width of bottom wall 110. The lengths of walls 104, 106, 108, and 110 may vary in different embodiments. In some embodiments, front wall 104, rear wall 106, top wall 108, and bottom wall 110 may all have equal lengths. In other embodiments, rear wall 106, top wall 108, and bottom wall 110 may all have a first length, while front wall 104 may have a second length shorter than the first length. In yet other embodiments, front wall 104, rear wall 106, and top wall 108 may all have a first length, while bottom wall 110 may have a second length shorter than the first length.

Still referring to FIGS. 1A and 1B, the front wall 104 may be shorter in length than the rear wall 106. In some embodiments, the front wall 104 may be roughly half the length of the rear wall 106. In some embodiments, the bottom wall 110 has a length equal to the length of the front wall 104. As will be discussed further with reference to FIGS. 2A-3, in some embodiments, the portion of the winch-receiving volume of the winch housing body 102 dedicated to housing a drum 140 and a cable 150, may be enclosed by the front wall 104, rear wall 106, top wall 108, and bottom wall 110. In other embodiments, the portion of the winch-receiving volume of the winch housing body 102 dedicated to housing a motor 130 may be partially enclosed by rear wall 106 and top wall 108.

Still referring to FIGS. 1A and 1B, any or all of the front wall 104, the rear wall 106, the top wall 108, and the bottom wall 110 may include apertures that provide various locations of ingress and egress. The apertures may be a variety of shapes and/or sizes. For instance, the apertures may be predominantly rectangular, square, oval shaped, or any other suitable shape. The size of the apertures may vary depending on each particular aperture's intended use or purpose. In some embodiments, the front wall 104 may include aperture 112. Aperture 112 may be predominantly rectangular in shape. Aperture 112 may be optimally sized to allow passage of the cable 150 therethrough. Also, top wall 108 and bottom wall 110 may include apertures 114 and 116, respectively. As depicted in FIGS. 1A and 1B, apertures 114 and 116 may be predominantly rectangular in shape. Apertures 114 and 116 may function to allow users access to the drum 140 and cable the 150. Therefore, apertures 114 and 116 may have a larger area than aperture 112. Apertures 114 and 116 may have an area optimal for a user to extend his or her hand and wrist within. In some embodiments, the top wall aperture 114 is directly above bottom wall aperture 116. In some embodiments, the top wall aperture 114 and the bottom wall aperture 116 are included in the portion of winch housing body 102 defining the winch-receiving volume dedicated to housing the drum 140 and the cable 150.

Winch housing body 102, including walls 104, 106, 108, and 110, may be formed of any suitable material. In some embodiments, the winch housing body 102, including walls 104, 106, 108, and 110, may be constructed from a metal or metal alloy. The front wall 104, the rear wall 106, the top wall 108, and the bottom wall 110 may be four individual members assembled or connected by any suitable attachment means. In one embodiment, each wall may be welded to any adjacent walls. In another embodiment, each wall may be connected to any adjacent walls with fasteners, such as screws or bolts. In this embodiment, walls 104, 106, 108, and 110 may include through bores to receive bolts or other fasteners. In another embodiment, two or more of walls 104, 106, 108, and 110 may be formed from a continuous piece of metal. In yet another embodiment, winch housing body 102, including the front wall 104, the rear wall 106, the top wall 108, and the bottom wall 110, may be formed of one continuous piece of material through an extrusion process, for instance. In some embodiments, the rear wall 106, the top wall 108, and the bottom wall 110 may be formed from a continuous piece of metal. In this embodiment, the top wall 108 and the bottom wall 110 may include through bores that are located to mate with through bores through the front wall 104.

Referring to FIG. 1A, winch housing body 102 may include an electrical cover 120. The electrical cover 120 may take any suitable size or shape. The electrical cover 120 may be predominantly square or rectangular in shape, for instance. The electrical cover 120 may include top surface 122, front shield 124, and lateral shield 127. The electrical cover 120 may also include a rear shield substantially identical to the front shield 124. The rear shield may be opposite the front shield across the top surface 122. The electrical cover 120 may also include a medial shield substantially identical to the lateral shield 127. The medial shield may be opposite the lateral shield 127 across the top surface 122. Lateral shield 127 may include brim 128B. The medial shield may include a similar brim. Electrical cover 120 may be attached to any portion of winch housing body 102, such as front wall 104, rear wall 106, top wall 108, or bottom wall 110. The electrical cover 120 may attach to winch housing body 102 at brim 128B and a brim of the medial shield by a variety of attachment means. Attachment means may include adhesives, welding, screws, fasteners, or any other suitable attachment means. In some embodiments, brim 128B, for instance, may include through bores that are located to mate with through bores through winch housing body 102. Any suitable fastener, such as a bolt, may then be placed through the mated through bores to fixedly secure the electrical box 120 to the winch housing body 102. In some embodiments, the electrical box 120 attaches to the top wall 108.

Figure 2A:
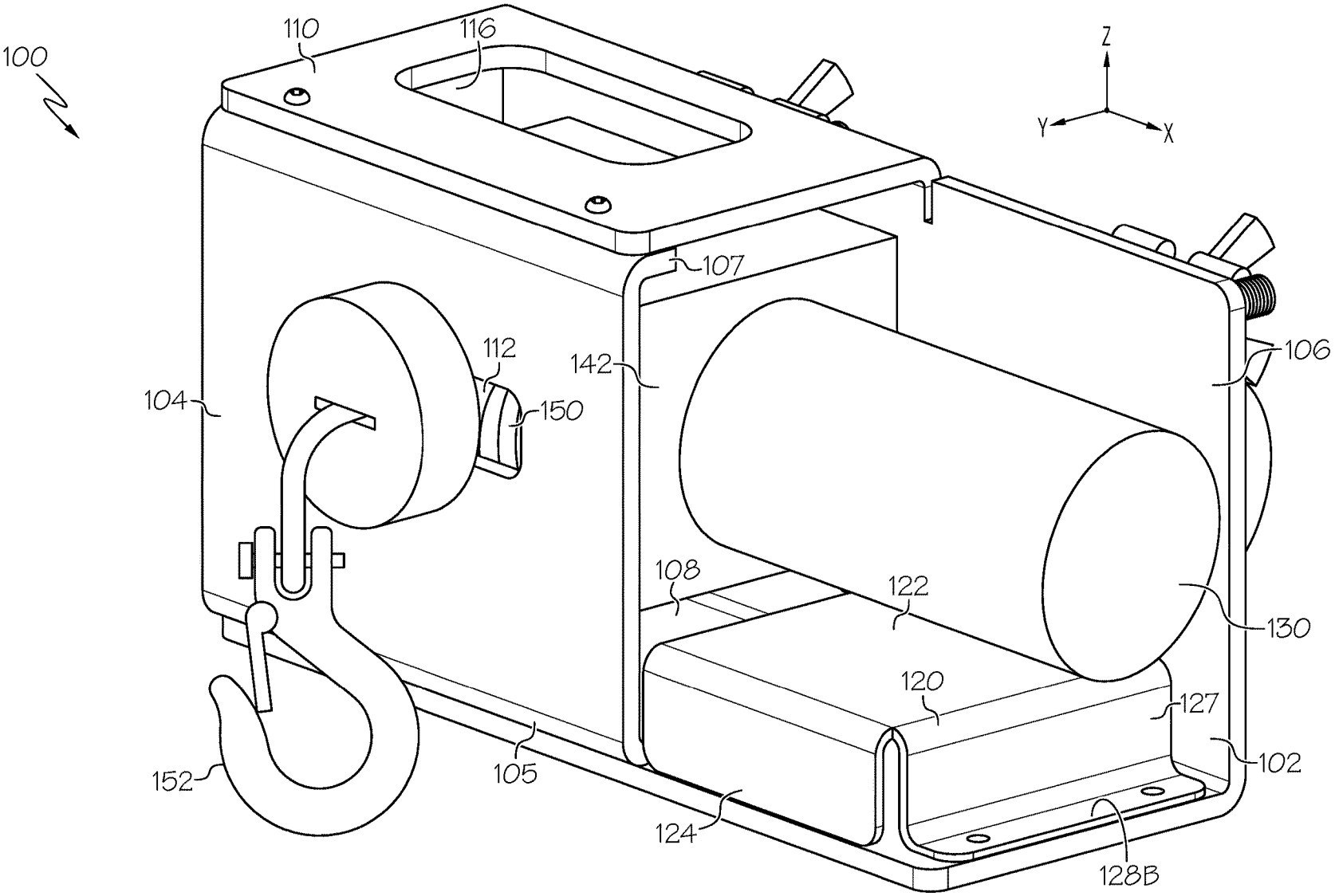
FIG. 2A is a front perspective view of a winch assembly including the winch housing body of FIG. 1A, according to one or more embodiments shown or described herein.

Referring now to FIG. 2A, the electrical cover 120 may be operatively attached to the winch housing body 102 to conceal any electronics associated with winch assembly 100. The electrical cover 120 may cover and conceal any electronics or wiring associated with the motor 130. In some embodiment, the electrical cover 120 may be operatively placed within the portion of the winch housing body 102 defining the winch-receiving volume dedicated to receiving the motor 130. The top surface 122, front shield 124, lateral shield 127, and complimentary rear shield and medial shield of the electrical cover 120, in conjunction with the portion of the winch housing body 102 that electrical cover 120 is fixedly secured to, create a predominantly sealed volume. The predominantly sealed volume may protect the electrical components housed within from damage and exposure.

Referring now to FIG. 1B, the winch housing body 102 may include one or more releasable clamp 160. By releasable, it is meant that the one or more releasable clamp 160 may be attached and removed from a support rail 180. The one or more releasable clamp may be removed from the support rail by a user by hand and without the need of additional tools. The one or more releasable clamp 160 may be removed from the support rail 180 without damaging the support rail 180, the clamp 160, or the winch assembly 100. Winch housing body 102 may include, for example, two or more releasable clamps 160. The one or more releasable clamp 160 may attach to the winch housing body 102 at any one or more of front wall 104, rear wall 106, top wall 108, and bottom wall 110. In the illustrated embodiment, one or more releasable clamp 160 may be attached to rear wall 106, extending from the side of rear wall 106 not defining the winch-receiving volume of winch housing body 102.

The one or more releasable clamp 160 may include a first portion 162 and a second portion 164. The first portion 162 may be fixedly secured to the winch housing body 102. The first portion 162 may be fixedly secured to the winch housing body 102 by any suitable attachment including, but not limited to, welding, adhesives, screws, and/or bolts. In some embodiments, the first portion 162 may include a through bore that aligns with a matching through bore in the rear wall 106. A bolt may then be inserted through the aligned through bores, securely fixing the first portion 162 to the rear wall 106.

Still referring to FIG. 1B, the second portion 164 of the one or more releasable clamp 160 may be rotatively secured to the first portion 162. The second portion 164 may be rotatively secured to the first portion 162 with a hinge, a pivot, a ball and socket joint, or any other suitable rotatable structure. In some embodiments, the second portion 164 may be attached to the first portion 162 at a hinge 166. The hinge 166 may be located at the end of the one or more releasable clamp 160 closest to top wall 108 or at the end of the one or more releasable clamp 160 closest to bottom wall 110.

The one or more releasable clamp 160 may also include a threaded fastener 168. The threaded fastener 168 may selectively couple the second portion 164 to the first portion 162. In some embodiments, the threaded fastener 168 is rotatively coupled to the first portion 162. The threaded fastener 168 may be rotatively coupled to the first portion 162 with a hinge, a pivot, a ball and socket joint, or any other suitable rotatable structure. In some embodiments, the threaded fastener 168 may be rotatively coupled to the first portion 162 at a fastener hinge 170. The fastener hinge 170 may be located at either the end of the one or more releasable clamp 160 closest to top wall 108, or the end of the one or more releasable clamp 160 closest to bottom wall 110. In either embodiment, the fastener hinge 170 may be located at the end of the one or more releasable clamp 160 opposite the hinge 166.

The threaded fastener 168 may be any fastener suitable to selectively couple the second portion 164 to the first portion 162. For instance, the threaded fastener 168 may be a pin, rod, screw, bolt, or any other fastener. The free end of second portion 164 not rotatively coupled to the first portion 162 at hinge 166 may include a fastener-receiving structure. For instance, second portion 164 may include a through bore. In other embodiments, second portion 164 may include a slot optimally sized to receive threaded the fastener 168. When the threaded fastener 168 is inserted through the fastener receiving slot of the second portion 164, the second portion 164 may be secured in a desired position on the threaded fastener 168 with a nut, for instance. In some embodiments, second portion 164 may be secured in a desired position with a wing nut.

The one or more releasable clamp 160 may be a variety of shapes and sizes chosen to operatively fit various support rails of differing widths or diameters. As depicted in FIG. 1B, the first portion 162 and the second portion 164 may both include interior curvature portions. The first portion 162 of the one or more releasable clamp 160 may include an inner curvature portion 172. The second portion 164 of the one or more releasable clamp 160 may include an inner curvature portion 174. Inner curvature portion 172 may or may not be equal in size to inner curvature portion 174. The maximum distance between inner curvature portion 172 and inner curvature portion 174 is the releasable clamp maximum cross-sectional dimension 176. Releasable clamp maximum cross-sectional dimension 176 may be increased or decreased depending on the rotational position of the second portion 164 in relation to the first portion 162. The releasable clamp maximum cross-sectional dimension 176 may be adjusted to selectively fit a support rail 180 of various shapes, sizes, or widths. The support rail 180 may be any elongated member a user wishes to attach the winch assembly 100 to. The support rail 180 may have a circular, square, or rectangular cross section, for instance.

Figure 2B:
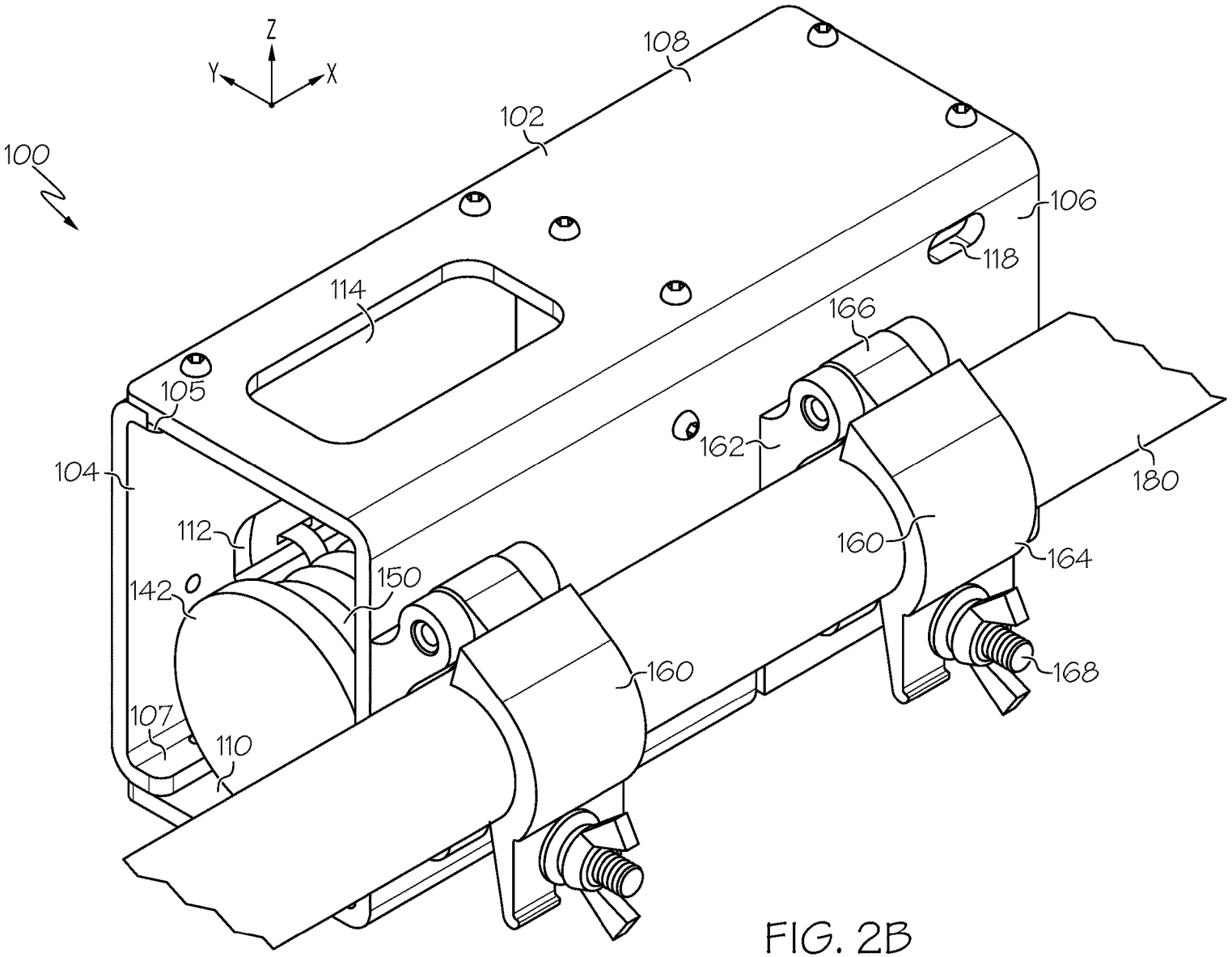
FIG. 2B is a rear perspective view of a winch assembly including the winch housing body of FIG. 1A, according to one or more embodiments shown or described herein.
Figure 3:
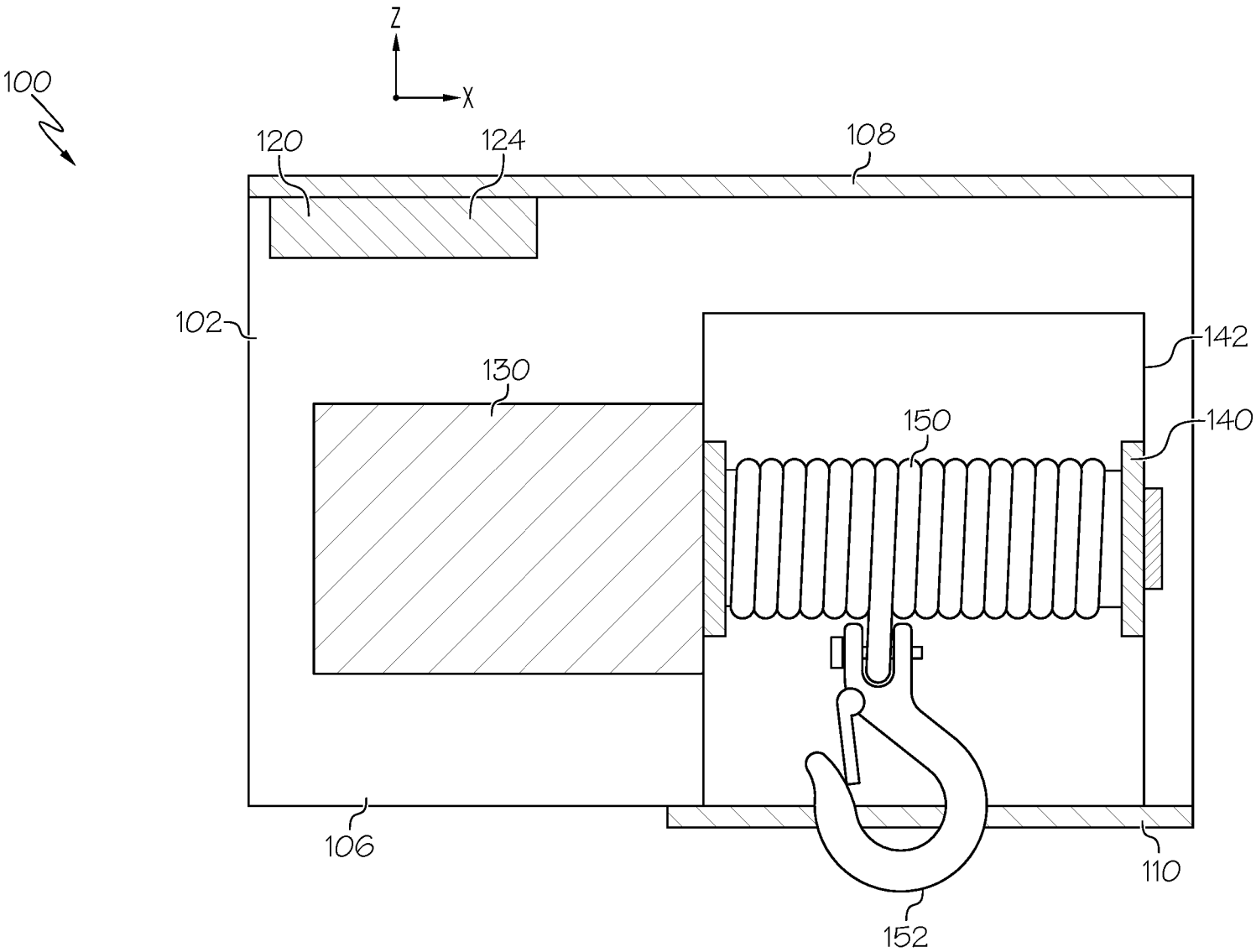
FIG. 3 is a diagrammable front view of the winch assembly of FIG. 2A with a front wall removed to illustrate a winch device, according to one or more embodiments shown or described herein.
Figure 4:
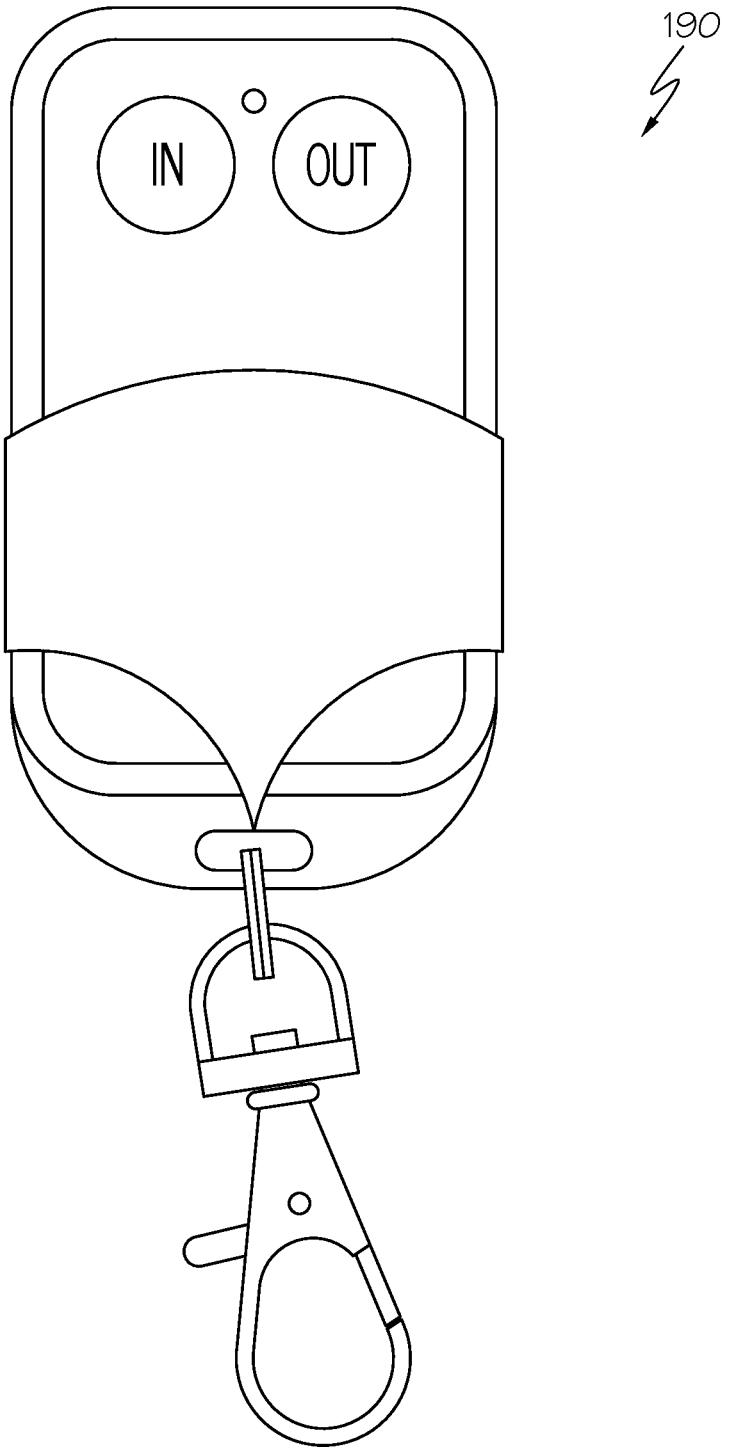
FIG. 4 is a front view of an electronic remote controller, according to one or more embodiments shown or described herein.

Referring now to FIG. 2A-3, the winch assembly 100 can be viewed with a winch device within the winch-receiving volume of the winch housing body 102. The winch device may include motor 130, drum 140, and cable 150. The motor 150 may be electrically powered. In some embodiments, the motor 150 may be electrically powered by a local battery contained within the winch assembly 100. In other embodiments, the motor 150 may draw power through external or remote batteries. For instance, the motor 150 may be able to draw power from a battery within a vehicle. The motor 150 may be able to draw power from an external battery through electric wires connected to the motor 150. The electric wires may extend from the motor 150, through an electric cable aperture 118 in the rear wall 106, and attach to any external battery. In other embodiments, the electric cable aperture 118 may be included in any of the front wall 104, rear wall 106, top wall 108, and/or bottom wall 110. In yet another embodiment, the motor 150 may be powered by a 12 volt battery. In some embodiments, the winch assembly 100 may include a motor controller operatively connected to the motor 150. The motor controller may be controlled by a remote controller 190. The remote controller 190 may provide an electronic signal to the motor controller, causing the motor controller to actuate the motor 130.

Still referring to FIGS. 2A-3, in some embodiments, the motor 130 may be within the winch-receiving volume defined by the rear wall 106 and the top wall 108 of the winch housing body 102. That is, in some embodiments, the motor 130 may not be enclosed by the front wall 104 or bottom wall 110. This allows users ease of access to the motor 130. Users may replace the motor 130, or cure any mechanical or electrical defects, for instance.

The winch device may also include the drum 140. The drum 140 may be rotatively coupled to the winch housing body 102. In another embodiment, the drum 140 may sit within a drum house 142. The drum house 142 may be fixedly secured to the winch housing body 102. For instance, the drum house 142 may include one or more through bores that align with one or more through bores in the rear wall 106. A bolt may be inserted through the aligned through bores, securely coupling the drum house 142 to the rear wall 106. The drum house 142 may also be secured to the rear wall 106 by any other securing means, such as adhesives or welding, for instance. The drum house 142 may also be fixedly secured to the front wall 104, rear wall 106, top wall 108, and/or bottom wall 110. The drum 140 may then be rotatively coupled to drum house 142 by one or more rotating bearings.

The drum 140 may be operatively coupled to the motor 130 by one or more gears. The one or more gears may translate the rotational speed of the motor 130 into an appropriate speed for the drum 140 to turn. In some embodiments a clutch is coupled between the motor 130 and the drum 140. In some embodiments, a brake is operatively coupled to the drum 140 to selectively prevent the drum 140 from rotating. In some embodiments, the brake defaults to a closed position, such that, upon a loss of power to one or more components of the winch device, the brake prevents rotation of the drum 140.

Still referring to FIGS. 2A-3, the winch device may also include the cable 150. The cable 150 may be made of a woven synthetic fiber such as, for example, nylon or polyester. The cable 150 may also be made from a metal such as, for example, a chain or wire made of a metal or a metal alloy such as steel, chromium, zinc, copper, or the like, or combinations thereof. The cable 150 may be operatively connected to the drum 140, allowing the cable 150 to wind or unwind in connection with rotation of drum 140. An attachment structure 152 may be attached to the cable 150 at the distal end of the cable 150. The attachment structure 152 may be a hook or spring snap link, for instance. In some embodiments, the cable 150 and the attachment structure 152 may extend through the aperture 112 in the front wall 104. The aperture 112 may be included in any of the walls 104, 106, 108, and 110, however. Therefore, the cable 150 and the attachment structure 152 may extend through any wall of the winch housing body 102. The aperture 112 may be sized such that the cable 150 does not contact the edges of the aperture 112 as the cable 150 winds or unwinds about the drum 140.

In some embodiments, the drum 140 and the cable 150 may be within the winch-receiving volume defined by the front wall 104, the rear wall 106, the top wall 108, and the bottom wall 110. Users may access the drum 140 and the cable 150 through the aperture 114 and the aperture 116.

Figure 5:
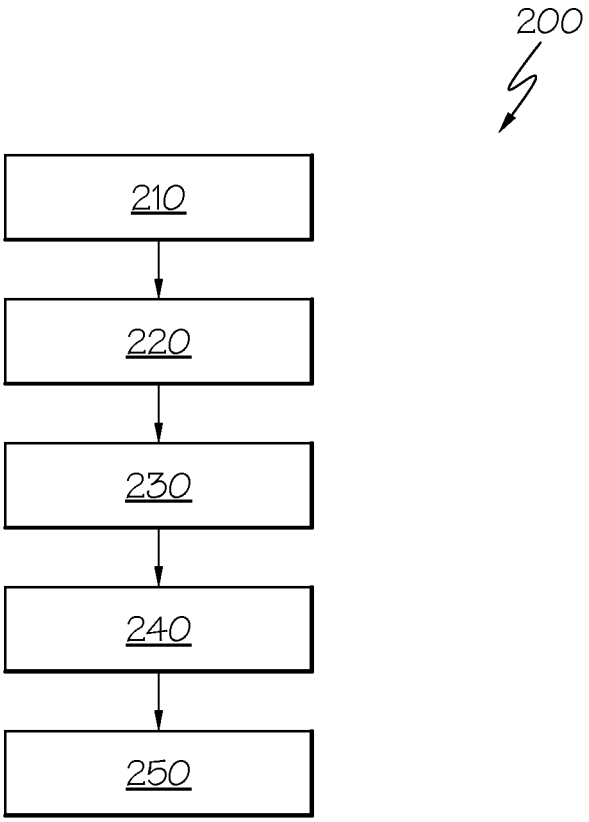
FIG. 5 is a flowchart depicting a method of operating a winch assembly, according to one or more embodiments shown or described herein.

Referring now to FIG. 5, the winch assembly 100 may include the electronic remote controller 190. The remote controller 190 may wirelessly communicate with a motor controller operatively connected to the motor 150. The remote controller 190 may provide an electronic signal to the motor controller, causing the motor controller to actuate the motor 130. The remote controller 190 may be a variety of shapes and sizes. In preferred embodiments, the remote controller 190 may be attached to a key chain of a user. The remote controller 190 may include a variety of buttons or other user interfaces. For instance, the remote controller 190 may include separate on and off buttons. The remote controller 190 may also include an out button and an in button, indicating whether the drum 140 will release the cable 150 from the winch housing body 102 or whether the drum 140 will draw the cable 150 into the winch housing body 102. The remote controller 190 may provide these functions to a user in any combination of switches, sliders, buttons, or other suitable user interface.

Referring now to FIG. 5, a schematic depiction of the operation of the winch assembly 100 is depicted. At step 210, a user may remove the winch assembly 100 from a first location. A user may remove the winch assembly 100 from a first location by loosening the one or more releasable clamp 160. The one or more releasable clamp 160 may be loosened by removing a fastener, such as a wing nut, from the threaded fastener 168. Once the wing nut or other fastener is removed from the threaded fastener 168, a user may rotate the second portion 164 of the one or more releasable clamp 160 about the hinge 166, effectively removing the second portion 164 from the threaded fastener 168. As the second portion 164 is slid off the threaded fastener 168, the friction between both the inner curvature portion 172 and the inner curvature portion 174 and a first support rail 180 is reduced. Once the second portion 164 is removed from the threaded fastener 168, the one or more releasable clamps 160 may be removed entirely from the first support rail 180. A user may then remove the winch assembly 100 from the first location.

At step 220, a user may attach the winch assembly 100 to a second location. The second location may be included on the object the user wishes to move or adjust. The user may identify a second support rail 180 to attach the winch assembly 100 to. The user may place the first portion 162 of the one or more releasable clamp 160 against a first side of the second support rail 180. The user may then rotate the second portion 164 of the one or more releasable clamp 160 about the hinge 166 toward the first portion 162. As the second portion 164 rotates toward the first portion 162, the second portion 164 contacts a second surface of the second support rail 180. The farther the second portion 164 rotates toward the first portion 162, the greater the friction between the one or more clamp 160 and the second support rail 180 becomes. The user may adjust the second portion 164 appropriately to fit support rails of multiple sizes. For instance, the farther the second portion 164 rotates toward the first portion 162, the smaller the releasable clamp maximum cross-sectional dimension 176, or the distance between the curvature portion 172 and the curvature portion 174, becomes. This allows the one or more releasable clamp 160 to maintain high friction with a relatively thin support rail 180. Once the user rotates the second portion 164 a suitable distance to create a desired friction between the one or more releasable clamp 160 and the second support rail 180, the user may rotate the threaded fastener 168 about the threaded fastener hinge 170. By doing so, the user lowers or raises, depending on the orientation of the one or more releasable clamp 160, the threaded fastener 168 to engage the second portion 164. The threaded fastener 168 may engage the second portion 164 by inserting into a slot in the second portion 164, for instance. Following this, the user may insert a fastener, such as a wing nut, onto the exposed end of the threaded fastener 168. The wing nut, for instance, may be tightened to abut the second portion 164, effectively preventing the second portion 164 from rotating away from the first portion 162 and maintaining a desired friction between the one or more releasable clamp 160 and the support rail 180.

After affixing the winch assembly 100 to the second support rail 180, the user may withdraw the cable 150 from the winch housing body 102 at step 230. The user may withdraw a desired length of the cable 150 from the cable aperture 112 to reach a specific grounded object. The user may do so by manually withdrawing the cable 150 from the winch housing body 102. In another embodiment, the user may actuate the motor 130, causing the drum 140 to rotate in a desired direction and extend slack of the cable 150 from the aperture 112. Once the cable 150 reaches a grounded object, the user may attach the cable 150 to the grounded object with the attachment structure 152 during step 240. The attachment structure 152 may be a hook or spring snap link.

Following this, the user may recoil the cable 150 during step 250. Using the remote controller 190, the user may activate the motor 130. The motor 130 may draw power from a local battery. In another embodiment, if the motor 130 draws power from an external battery, the user may extend electric cables through the aperture 118 and attach electric cables to a suitable battery prior to activating the motor 130. Once activated, the motor 130 causes the drum 140 to turn. As the drum 140 turns, the cable 150 operatively connected to the drum 140 winds around the drum 140. As the cable 150 winds around the drum 140, the length of the cable 150 extending from the cable aperture 112 shortens. The tension in the cable 150 moves or reorients the object of interest that contains the second support rail 180. Once the object of interest is sufficiently repositioned, the user may turn off the motor 130 and safely remove the attachment structure 152 from the grounded object. Following this, the user may reactivate the motor 130 to recoil any remaining slack left in the cable 150.

While in the above discussion of FIG. 5, the winch assembly 100 is first removed from an operative location, it should be apparent that the winch assembly 100 does not need to be moved from an operative location prior to use. For instance, the winch assembly 100 may be moved from a storage location prior to use. It should also be understood that the winch assembly 100 may be used to move or reorient any suitable object. For instance, the winch assembly 100 may be used to move or reposition a vehicle, a light pole, a tent pole, etc.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A winch assembly, comprising:

a winch housing body comprising:

a front wall;
a rear wall; and
at least one connecting wall that extends between the front wall and the rear wall;
the front wall, rear wall, and connecting wall defining a winch-receiving volume sized to house a winch device therein, the winch device further comprising:
a motor;
a drum that is operatively connected to the motor; and
a cable that is operatively connected to the drum;
an attachment structure at a distal end of the cable; and
one or more releasable clamps mounted to the rear wall that is configured to clamp around support rails of differing widths.

2. The winch assembly of claim 1, wherein the front wall includes a cable-receiving aperture through which the cable extends during a winching operation.

3. The winch assembly of claim 2, wherein the front wall has a shorter length than the rear wall, providing an open area wherein the motor of the winch device is housed.

4. The winch assembly of claim 3 comprising an electrical cover that is attached to the at least one connecting wall.

5. The winch assembly of claim 3, wherein the at least one connecting wall is one of a top wall and a bottom wall.

6. The winch assembly of claim 5, wherein the bottom wall has a same length as the front wall.

7. The winch assembly of claim 6, wherein an electrical cover is attached to the top wall within the open area.

8. The winch assembly of claim 5 comprising the top and bottom walls that each include an aperture configured to allow a user access to the winch device.

9. The winch assembly of claim 8, wherein the aperture in the top wall is positioned over the aperture in the bottom wall.

10. The winch assembly of claim 9, wherein the drum is positioned between the aperture in the top wall and the aperture in the bottom wall.

11. The winch assembly of claim 2, wherein the at least one connecting wall includes an aperture that is configured to allow a user access to the winch device.

12. The winch assembly of claim 11, wherein the aperture in the at least one connecting wall has a larger area than the cable-receiving aperture in the front wall.

13. The winch assembly of claim 1, wherein the one or more releasable clamps include a first portion and a second portion, wherein the second portion is rotatively coupled to the first portion.

14. The winch assembly of claim 13, wherein the second portion of the one or more releasable clamps is selectively coupled to the first portion of the one or more releasable clamps with a threaded fastener.

15. A method of moving an object with a winch assembly, comprising the steps:
detaching a winch assembly from a first position, the winch assembly comprising:
a winch housing body comprising:
a front wall;
a rear wall; and
at least one connecting wall that extends between the front wall and the rear wall;
the front wall, rear wall, and connecting wall defining a winch-receiving volume sized to house a winch device therein, the winch device further comprising:
a motor;
a drum that is operatively connected to the motor; and
a cable that is operatively connected to the drum;
an attachment structure at a distal end of the cable; and
one or more releasable clamps mounted to the rear wall that is configured to clamp onto support rails of differing widths;
attaching the winch assembly to a second position using the one or more releasable clamps; and
activating the winch assembly.

16. The method of claim 15, wherein the first position and the second position are different positions on the same object.

17. The method of claim 16, wherein the winch assembly, when attached to the first position and activated, moves the object in a first direction, and wherein the winch assembly, when attached to the second position and activated, moves the object in a second direction.

18. The method of claim 15, wherein the first position and the second position are on different objects.

19. The method of claim 15, wherein the winch assembly is detached from the first position by loosening the one or more releasable clamps and the winch assembly is attached to the second position by tightening the one or more releasable clamps.

20. The method of claim 15, wherein the winch assembly is activated by an electric remote controller.

* * * * *